US008387504B2

(12) United States Patent
Cairo et al.

(10) Patent No.: US 8,387,504 B2
(45) Date of Patent: Mar. 5, 2013

(54) FIBER-REINFORCED AL-LI COMPRESSOR AIRFOIL AND METHOD OF FABRICATING

(75) Inventors: Ronald Ralph Cairo, Simpsonville, SC (US); Jianqiang Chen, Greer, SC (US)

(73) Assignee: General Electric Company, Schenectady, NY (US)

( * ) Notice: Subject to any disclaimer, the term of this patent is extended or adjusted under 35 U.S.C. 154(b) by 171 days.

(21) Appl. No.: 12/985,825

(22) Filed: Jan. 6, 2011

(65) Prior Publication Data

US 2012/0177501 A1 Jul. 12, 2012

(51) Int. Cl.
*D04C 1/02* (2006.01)

(52) U.S. Cl. ..... 87/1; 87/5; 87/13

(58) Field of Classification Search ..... 87/1, 5, 87/8, 13

See application file for complete search history.

(56) References Cited

U.S. PATENT DOCUMENTS

| | | | | |
|---|---|---|---|---|
| 3,572,971 | A | 3/1971 | Seiwert | |
| 3,594,288 | A | 7/1971 | Reinert | |
| 3,602,608 | A | 8/1971 | Morley | |
| 3,694,104 | A | 9/1972 | Erwin | |
| 3,762,835 | A | 10/1973 | Carlson et al. | |
| 3,895,922 | A | 7/1975 | Phillips | |
| 4,108,572 | A | 8/1978 | Platt | |
| 4,930,983 | A * | 6/1990 | Byrnes et al. | 416/134 A |
| 5,001,023 | A * | 3/1991 | Cheshire et al. | 429/94 |
| 5,375,978 | A | 12/1994 | Evans et al. | |
| 5,785,498 | A | 7/1998 | Quinn et al. | |
| 5,881,775 | A * | 3/1999 | Owen et al. | 138/149 |
| 5,921,754 | A * | 7/1999 | Freitas et al. | 416/230 |
| 6,074,716 | A * | 6/2000 | Tsotsis | 428/35.7 |
| 6,451,416 | B1 * | 9/2002 | Holowczak et al. | 428/293.4 |
| 6,696,144 | B2 * | 2/2004 | Holowczak et al. | 428/293.4 |
| 8,057,534 | B2 * | 11/2011 | Boismier et al. | 623/1.38 |
| 2002/0155269 | A1 * | 10/2002 | Holowczak et al. | 428/294.7 |
| 2005/0261760 | A1 * | 11/2005 | Weber | 623/1.38 |
| 2008/0082162 | A1 * | 4/2008 | Boismier et al. | 623/1.38 |
| 2008/0183277 | A1 * | 7/2008 | Atanasoska et al. | 623/1.15 |
| 2009/0152391 | A1 * | 6/2009 | McWhirk | 244/30 |

* cited by examiner

*Primary Examiner* — Shaun R Hurley

(74) *Attorney, Agent, or Firm* — McNees Wallace & Nurick LLC

(57) ABSTRACT

A metal matrix composite lightweight compressor airfoil. The airfoil comprises a braided fabric embedded in a lightweight aluminum-lithium alloy. The airfoils are fabricated by forming a plurality of fiber tows by twisting filaments or fibers. The tows are then braided into a fabric. The fabric may be impregnated with an optional fugitive polymer that temporarily occupies interstices of the fabric to facilitate handling of the pre-formed braided fabric, but which is subsequently removed. The airfoil may then be formed as a MMC by one of two separate methods. In the first method, aluminum-lithium alloy is pressure augmented casting into a die that includes a preform of fabric impregnated with fugitive polymer. In a second method, a preform is formed using a tool and mandrel by impregnating fabric with aluminum-lithium alloy. Then aluminum-lithium alloy is pressure augmented cast into a die that includes the alloy-impregnated preform.

15 Claims, 5 Drawing Sheets

FIG−4

FIBER-REINFORCED AL-LI COMPRESSOR AIRFOIL AND METHOD OF FABRICATING

FIELD OF THE INVENTION

The present invention is generally directed to a metal matrix composite article, and more specifically directed to a compressor airfoil utilizing braided fabric tows in a metal matrix of aluminum lithium.

BACKGROUND OF THE INVENTION

Improvements in manufacturing technology and materials are the keys to increased performance and reduced costs for many articles. As an example, continuing and often interrelated improvements in processes and materials have resulted in major increases in the performance of gas turbine engines. A gas turbine engine draws in and compresses air with an axial flow compressor, mixes the compressed air with fuel, burns the mixture, and expels the combustion product through an axial flow turbine that powers the compressor. The compressor includes a disk with blades projecting from its periphery. The disk turns rapidly as part of the rotor, and the curved blades draw in and compress air in somewhat the same manner as an electric fan.

Since it takes energy to rotate the gas turbine at high speeds, any efforts to reduce the weight of the gas turbine will improve the efficiency of the gas turbine. More importantly, reducing the weight of rotating components reduces the stresses of the components and enhances the reliability of the gas turbine. One of the areas in which weight can be reduced is the compressor. Compressor components such as compressor airfoils, which include both compressor blades and compressor vanes, are made from steel and iron-base alloy parts that are relatively heavy. Efforts have been made to reduce the weight of these steel and iron-base alloy parts by producing hollow airfoils. However, these airfoils still afford opportunity for weight reduction.

Other attempts for reducing the weight of compressor airfoil components have included both metal matrix composite components (MMCs) and polymer composite blades. Fiber composite blades have been utilized, such as the fan blades described in U.S. Pat. No. 5,375,978, which is modified to include a metallic protection strip such as set forth in U.S. Pat. No. 5,785,498, which also helps provide erosion protection for the fan blade and assists in preventing delamination in the event of impact by a foreign object to minimize foreign object damage (FOD). Both of these patents are assigned to the assignee of the present invention. Such blades are light in weight but are very expensive to manufacture, having high scrap rates. Furthermore, these blades are suitable for use in fan applications where the fan is rotating at a much slower speed than a compressor blade. The compressor blade thus is subject to significantly higher stresses than fan blades.

Compressor blades using MMCs have been manufactured using fabric laid up in the traditional manner and covered with a sheath of titanium or clad with other material. These blades also have proven to be expensive to make and lacking in the strength required for land-based gas turbine operations. Other attempts have included a metallic spar having an outer surface reinforced with a metal matrix composite material, the surface exposed to the atmosphere being metal. While these MMC blades prove to have greater strength, the weight reduction is not as great as with blades having fiber reinforced cores.

What is need is a compressor airfoil that provides weight reduction, yet can have sufficient durability and strength to be used for land-based turbine operation. In addition to being light in weight, the airfoil ideally should also be tunable for resonant frequency control. The airfoil also should be easy and inexpensive to manufacture, with a high yield.

BRIEF DESCRIPTION OF THE INVENTION

A composite lightweight article, comprises a near surface braided fabric embedded in a lightweight metal. The article may be an airfoil. The braided fabric is formed from a plurality of twisted fiber tows braided and oriented in a direction so that each of the plurality of tows extend at an angle to a principle direction of the article. The principle direction may be any direction, but usually is the direction of maximum stress application. The principle direction extends from a first end toward a second end in the direction of maximum stress application, and the plurality of fiber tows extend at an angle to the principle direction. The article further includes a core of an aluminum lithium alloy. The aluminum-lithium alloy penetrates the interstices of the braided fabric and the plurality of twisted fiber tows to form an outer surface of aluminum lithium alloy. The aluminum-lithium alloy is substantially continuous from the core to the outer surface through the interstices of the fabric and the plurality of twisted fiber tows.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
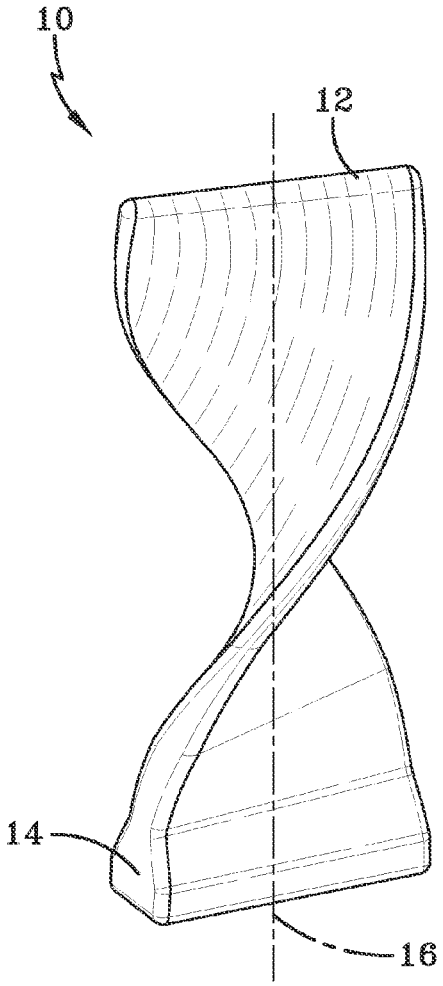
FIG. 1 is a perspective view of a compressor blade of the present invention.

A metal matrix composite lightweight compressor airfoil comprising a braided fabric embedded in a lightweight metal is described herein. The airfoil may be a blade or a vane, although the airfoil is preferably a compressor blade as the compressor blade, attached to a disc in a gas turbine engine that rotates with the engine, experiences higher levels of stress, while a compressor vane is fixed in position and redirects the air that is moved by the airfoil blade toward the combustor, but does not see such high levels of stress. Nevertheless, the metal matrix composite of the present invention may find use as a vane since it can provide acceptable strength while reducing weight in the engine, which further improves efficiency. The braided fabric is manufactured to provide additional strength to the metal matrix composite airfoil in a radial direction, where high stresses are experienced, particularly by a rotating compressor blade.

Certain definitions are set forth for terms used throughout this disclosure. As used herein, incidental impurities means additional and different elements in the alloy present in quantities so as not to affect the nature and characteristics of the alloy. A tow is a bundle of continuous filaments arranged in a form without a definite twist. Twist refers to the spiral turns about an axis per unit of length of filament. Twist is expressed in turns per inch. A filament is single continuous fiber and is the smallest or basic unit of fibrous material. The term fiber is used interchangeably with filament. Fabric is a material made of braided fibers, filaments, monofilaments or tows. Oxide ceramic fibers include silica-alumina and alumina fibers. Non-oxide ceramic fibers include silicon carbide fibers. Carbon fibers are based on ordered planar structures of carbon. Aramid fibers are crystalline polymer fibers. Oxide glass fibers are derived from a mixture of oxides: silica, or quartz fibers are from a single oxide. Yarn is an assembly of twisted tows to form a continuous length. Braided fabric, or fabric, is a material formed by interlacing yarns, tows and/or filaments to form a fabric pattern. The radial length of a blade runs from the blade tip to the dovetail as the blade projects from a disk. Span is the airfoil portion of an airfoil or blade that does not include the dovetail. The axis of the blade is a line running in the radial direction through the center of the span from the blade tip to the blade dovetail. Twist angle is the amount of twist around the radial axis of a blade or an airfoil. Chord width is the width of blade. The airfoil surface is a surface offset from the chord which is the shortest distance from a point on the leading edge to the trailing edge.

A compressor blade has a tip located at its end distal from the disc. The blade has an airfoil section that has a suction side and a pressure side. The pressure side experiences higher stress than does the suction side of the blade airfoil section. The blade is attached to the disc at the end opposite its tip. It typically is attached to the disc using a dovetail, although other arrangements for attaching a blade to the disc may be used. The woven fabric comprises a yarn formed from a plurality of twisted fiber tows. The fiber tows are braided and oriented in a direction. The blade extends radially outward from the disc, which is part of the rotor. An axis of the blade extends along the span of the blade from the blade attachment to the disc, usually a blade dovetail, to the blade tip in what is commonly termed the radial direction. A vane has a similar orientation in the engine as a blade, extending in the compressor substantially perpendicular to the direction of the airflow and a similarly oriented axis. Unlike a blade, a vane is substantially stationary, although in some circumstances, a vane may have the ability for limited rotation about its axis in order to more efficiently direct the flow of air through the compressor.

The fiber tows are formed into a braided fabric by braided the fiber tows. The fabric has interstices between the braided fiber tows and any space that may exist in the plurality of twisted fiber tows. The fabric is positioned within the airfoil so that the braided fiber tows forming the fabric extend at an angle to the axis of the core while extending in the radial direction from one end of the airfoil to the other. In the case of a blade, the braided tows in the yarn extend from the tip at least partially into the dovetail of the blade. A lightweight metallic alloy, such as an aluminum lithium alloy forms the core of the airfoil and fills the interstices in the fabric. Ideally, the metallic alloy forms the outermost surface of the airfoil, so that the lightweight metallic alloy is a continuous matrix along the airfoil cross section from the airfoil core to its outer surface and along the radial direction of the airfoil.

The airfoils are fabricated by forming a plurality of fiber tows by twisting filaments or fibers. The tows are then braided into a fabric. The fabric is braided from the tows or yarn so that it includes interstices between the tows. The fabric may be impregnated with an optional fugitive polymer that temporarily occupies the interstices of the fabric to facilitate handling of the pre-formed braided fabric, but which is subsequently removed. The airfoil may then be formed as a metal matrix composite (MMC) by one of two separate methods.

In a first method, a braided tow-base preform is braided and left in a dry (unrigidized) state. The dry preform is placed over a mandrel. Aluminum lithium foils are then placed between the dry preform and the mandrel, with additional aluminum lithium foils placed over the dry braided preform to form a sandwich comprising foils, dry preform and foils. This assembly is then inserted into a precision machined female tool having airfoil contours, and subsequently hot pressed to create a fiber reinforced metal-matrix preform.

The hot pressing process is performed in a vacuum or in a non-oxidizing atmosphere. This may be done in a furnace. When performed in a furnace, prior to heating, a vacuum is drawn or a non-oxidizing atmosphere is introduced into the furnace to purge the tool that contains the dry preform. During the hot pressing process, the protective atmosphere and other effluent gases may be drawn out by vacuum pumping. The use of the non-oxidizing atmosphere is particularly beneficial to prevent oxidation of either the fibers/filaments, the metal alloy or both. The preform comprising metal alloy and braided fiber is heated to a predetermined temperature above the melting point of the metal alloy while pressure is applied to the tool. The molten Al—Li alloy infiltrates the interstices of the fabric, through the fabric and against the face of the tool so that Al—Li alloy and braided carbon fiber forms a metal matrix preform that has the contour of the outer surface of the tool, the tool having the shape of an airfoil. After cooling, the tool containing the airfoil may be removed from the furnace. Since the tool is near net shape, only minor operations are required to the preform, such as removing any flash that may be present. The metal matrix preform is ready for the die casting process to produce the integral core with integral airfoil attachment, which die casting process includes pressure augmented die casting described below.

In a second method of producing a carbon fiber preform, a braided tow-base preform is placed over a mandrel and into a precision tool in the shape of the airfoil. Fugitive polymer binder may be impregnated into the braided fiber to rigidize the braided carbon fiber. The impregnated fiber is cured at or near ambient temperature. The braided fiber preform is placed against the face of the tool and oriented so that the tows form an angle with the axis of the airfoil or blade, the tows extending along the airfoil section from the first end of the airfoil, the tip of the airfoil when it is a blade, toward and at least partially into a second end of the airfoil, the dovetail when the airfoil is a blade. Fugitive polymer binder is applied while the braided fiber is laid against the tool. After curing, the preform requires only minor trimming to be ready for the die casting process.

The die casting process is performed in a protected enclosure similar to a vacuum furnace. Prior to heating, a non-oxidizing atmosphere is introduced into the furnace to purge the die with the preform. During the casting process, the protective atmosphere and other effluent gases are drawn from the enclosure by a vacuum pump. The use of the non-oxidizing atmosphere is particularly beneficial to prevent oxidation of either the fibers/filaments, the metal alloy or both. The aluminum-lithium alloy is heated to a predetermined temperature above the melting point of the alloy. Molten metal is then pressure-augmented cast into the die using a piston at a predetermined speed and pressure. The metal is injected at a first pressure sufficient to force the molten metal into the die, but not so high as to result in the preform shifting its position. After the die is substantially filled with molten metal, a second pressure higher than the first pressure is applied to the molten metal in the die. This higher pressure assures that the molten metal flows into and through the interstices of the preform, allowing metal to flow between the preform and the die surfaces. At the same time, if an optional fugitive polymer binder was used to improve the handling of the fabric and preform, it flows into a sprue or riser of the die where it can be removed during subsequent processing. After cooling the die containing the near net shape airfoil may be removed from the non-oxidizing atmosphere. Since the die is near net shape, only minor operations are required to the airfoil. However sprue or riser material must be removed as well as any flash that may be present as a result of the pressure augmented casting process.

FIG. 1 depicts an integrated hybrid blade 10 of the present invention. Blade 10 has a blade tip 12, a blade dovetail 14 that attaches blade 10 to the compressor disk (not shown) and a blade axis 16 extending substantially in the radial direction.

Figure 2:
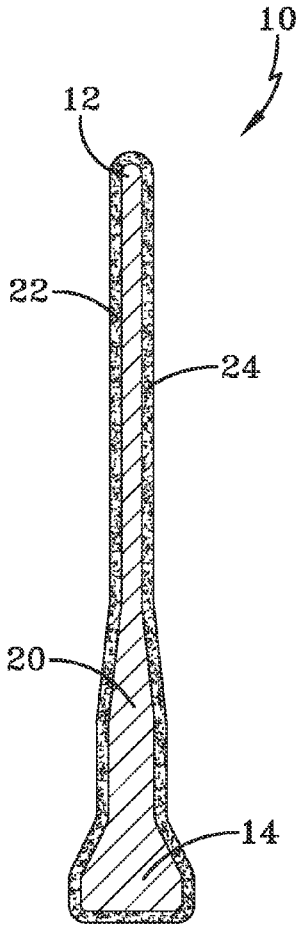
FIG. 2 is a cross-section of a compressor blade of the present invention.

FIG. 2 is a cross sectional side view of a hybrid blade illustrating a near surface braided fabric 22 located between the metal alloy core 20 and the metal alloy outer surface 24 of the blade. The metal alloy that forms core 20 and outer surface 24 of blade 10 is substantially continuous from the core to the outer surface, extending through interstices in the fabric. The near surface braided fabric provides additional strength to the alloy, which is a light weight alloy that reduces the overall weight of the blade. The braided fabric is positioned to add strength to the lightweight alloy at locations of high stress. In a rotating compressor blade, areas of high stress will vary based on blade design, but will generally be found on the pressure side of blade 10 and extend into the dovetail region, where blade 10 is held in the compressor disk by its dovetail 14. Blade 10 experiences stresses due to centrifugal forces of rotation and aerodynamic load, and dovetail 14 counters these forces by interacting against the compressor disk. While the alloy may be any lightweight alloy, a preferred light weight alloy is an aluminum lithium alloy comprising in weight percent, about 2.5-3.5% lithium (Li), about 0.6-2.5% copper (Cu), about 0.3-1.0% magnesium (Mg), about 0.1-0.5% zirconium (Zr), up to about 0.08% iron (Fe), up to about 0.01% silicon (Si), up to about 0.03% titanium (Ti), the balance aluminum (Al) and incidental impurities. The density of this aluminum lithium alloy is about 0.100 lb/in$^3$.

Figure 3:
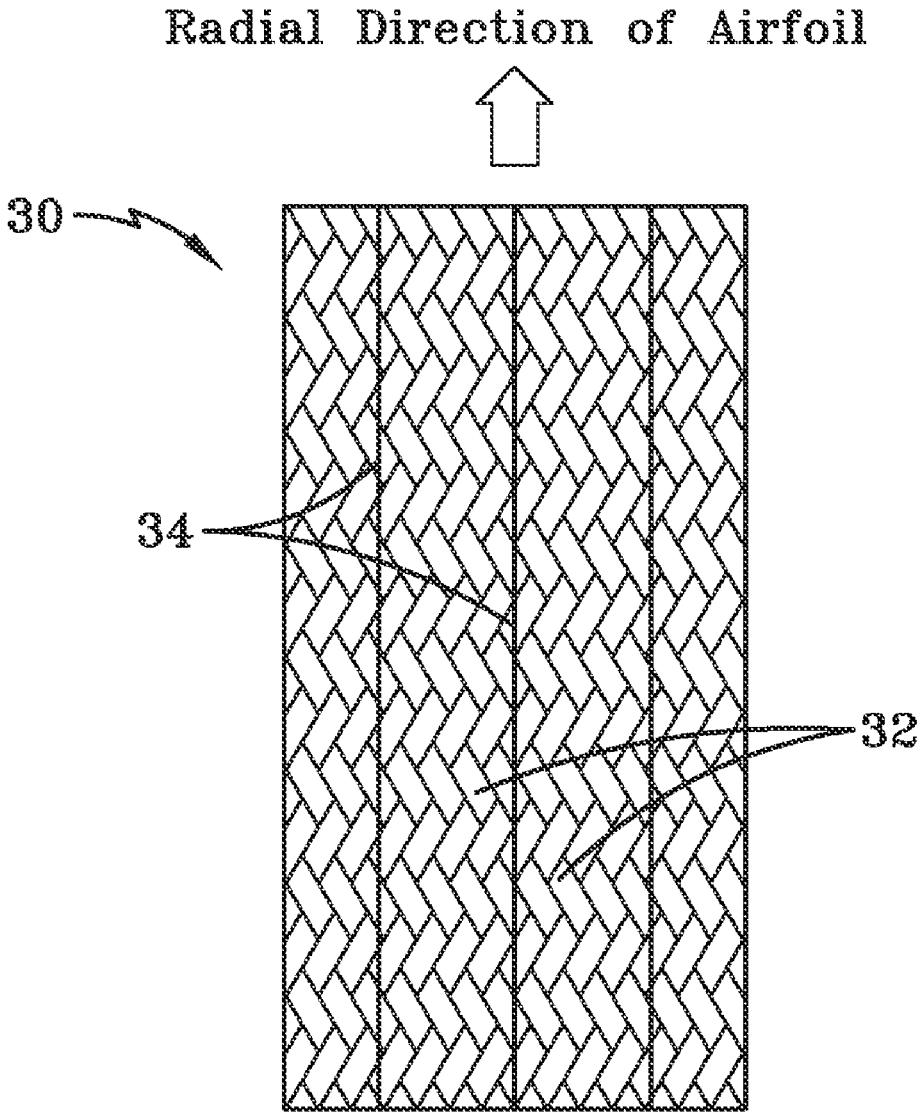
FIG. 3 depicts the construction of the fabric of the present invention woven at an angle to the axis of the blade and includes stuffer tows provided substantially in the radial direction of the blade and substantially parallel to the axis.
Figure 4:
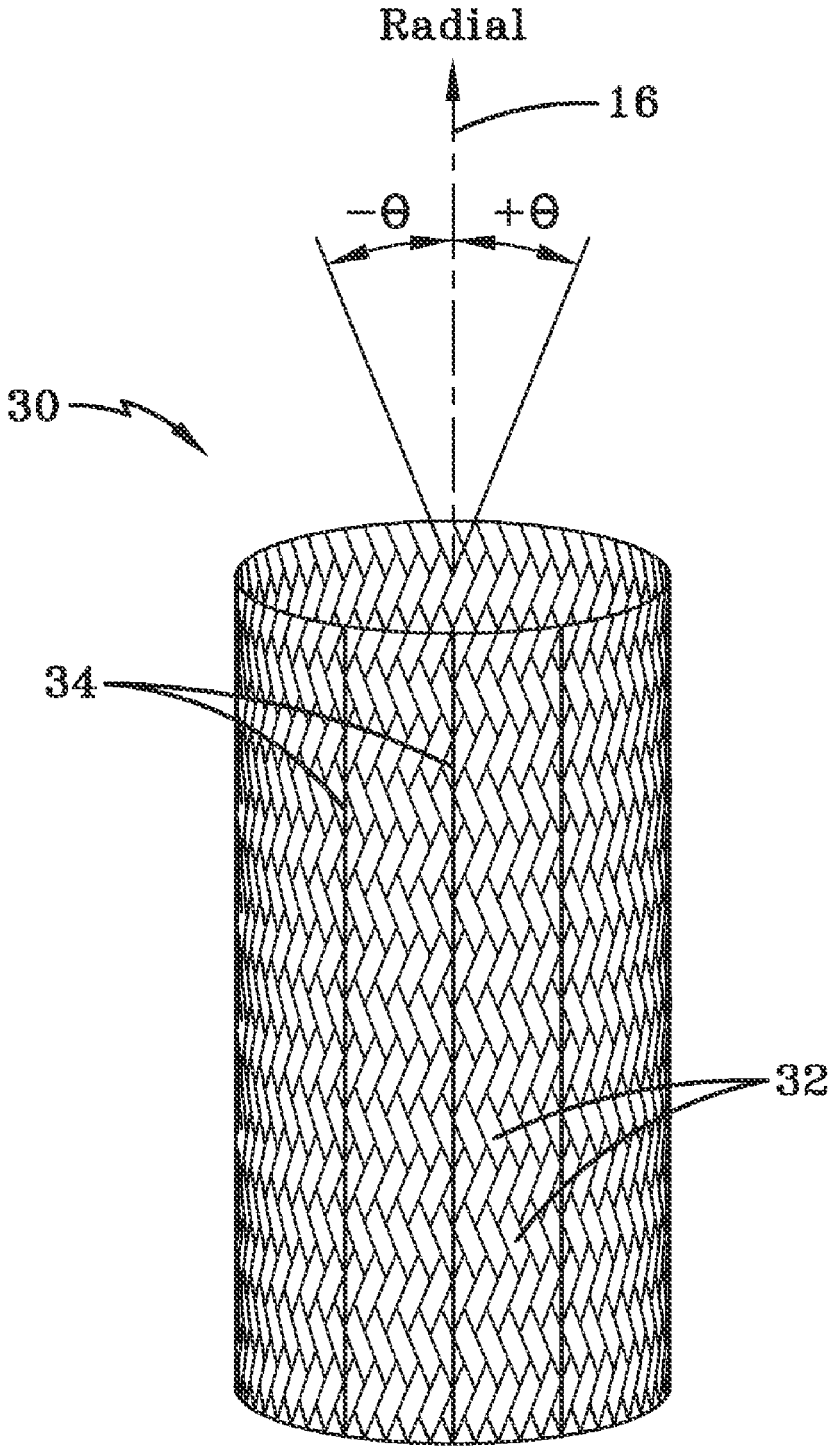
FIG. 4 is perspective view of the woven fabric of FIG. 3 formed generally into a sock-like shape.

Referring now to FIGS. 3 and 4, the construction of braided fabric 30 is depicted. Each tow 32 comprises one or more fibers arranged in a fiber bundle. Tows 32 are then twisted and woven together to form woven braided fiber tows or braided fabric 30. The braided tows of the braided fabric extend at an angle with respect to axis 16 of airfoil or blade 10. It has been found that the braided fabric 30 is most effective in strengthening the blade when the braided tows of braided fabric form an angle of from about ±10° to about ±25° to the axis of the airfoil. As previously noted, axis 16 extends in a radial direction from the blade or airfoil dovetail 14 to blade tip 12. FIG. 4 is a perspective view of braided fabric 30 extending at an angle to axis 16. This perspective view provides the sock-like quality of braided fabric 30. Interstitial areas devoid of material exist in braided fabric 30 between fiber tows. Fabric may be comprised of carbon fiber, ceramic fiber, either oxide ceramic fiber or non-oxide ceramic fiber, nylon fiber, aramid fiber and combinations thereof. The fiber may be high strength and high stiffness, but may be mixed with fiber of low strength to provide damage tolerance to a tow if desired. While fiber or filament of the same size may be used, fibers of different diameters are also envisioned to form tows, and tows of different diameters may be used to form braided fabric. Carbon fiber is the preferred fiber. Carbon fiber of varying strengths and of varying modulus is readily available. The density of braided fabric formed into a preform is about 0.58-0.6 lbs/in$^3$.

When additional strength is required for an airfoil, optional stuffer tows 34 may be added to woven fabric 30. These stuffer tows are depicted in both FIGS. 3 and 4. Stuffer tows 34 extend in a direction that is substantially parallel to the direction of axis 16, or substantially in the radial direction of airfoil 10. Stuffer tows also may be placed or braided into braided fabric by threading through interstitial areas or otherwise attached to the interior or exterior of woven fabric 30. Stuffer tows 34 are added to those areas in which high stress concentrations are predicted. Stuffer tows 34 are designed so that some of the stresses will be carried by the fiber in the tow rather than being borne solely by the metal matrix composite comprising woven fabric and the light weight alloy. The number of stuffer tows 34 and the spacing of stuffer tows 34 will vary depending on localized design conditions using, for example, lamination theory and finite element analysis. Stuffer tows will improve the load-carrying capability in those areas in which they are added. As noted previously, the pressure side of airfoils may experience the highest stresses. In addition, the leading edge and the trailing edge of airfoils may also experience high stresses. While the exact placement of stuffer tows is determined by an analysis of stress conditions in each blade design, the pressure side of airfoils and the leading and trailing edges are the regions of the blade where stuffer tows 34 are most likely to be placed. Stuffer tows may comprise up to about 15% by volume of the braided fabric when added to the braided fabric. Stuffer tows may be comprised of carbon fiber, oxide ceramic fiber, non-oxide ceramic fiber and combinations thereof. For example, on a typical blade having a width of about 8-10", stuffer tows may be positioned about one inch apart on the pressure side of the blade and may comprise up to about 10% of the chord. One or two stuffer tows may be included on the suction side of the blade. Stuffer tows ideally are low modulus, for example about 24 million pounds per square inch (Msi), and high strength. A preferred stuffer tow having a modulus of about 24 Msi may have a tensile strength of about 300,000-700,000 pounds per square inch (300-700 ksi). Stuffer tows may be high strength carbon fiber tows, ceramic fiber tows or monofilament boron fiber tows. As an alternative, a tri-axial braid incorporating radial and ±angular oriented tows in a unitized braid may be employed, and the tri-axial braid may include stuffer tows or softening strips, discussed below.

Optional softening strips may be used in addition to or in place of stuffer tows 34. Softening strips also are oriented in a direction that is substantially parallel to the direction of axis 16, or substantially in the radial direction of airfoil 10. Softening strips provide damage tolerance to the blade. Softening strips are also characterized by low modulus and high strength, although softening strips generally have a lower modulus than stuffer tows. For example, a softening strip may have a modulus of about 10-15 Msi. Softening strips assist in arresting cracks, thereby hindering crack propagation. Softening strips may be tows of high strength carbon fiber, fiberglass fiber, nylon fiber, aramid fiber and combinations thereof. It is preferred that softening strips be placed in areas of low stress. Softening strips may be added to braided fabric 30 in the same manner as stuffer tows 34, or as radial tows in tri-axial braided fabric. Softening strips are very useful, for example, in applications in which the airfoil experiences vibration problems, allowing for tuning of the airfoil. Softening strips may comprise up to about 5% additional by volume of the braided fabric.

An airfoil may advantageously utilize both stuffer tows 34 and softening strips. Softening strips may be located in areas adjacent to stuffer tows. Since stuffer tows 34 are located in area in which stresses are high, these areas may experience a condition which may result in an overstressed condition causing a rupture of a stuffer tow, which may also lead to a localized crack. Strategic position of a softening strip provides crack arrestment capability to hinder propagation of the crack.

Figure 5:
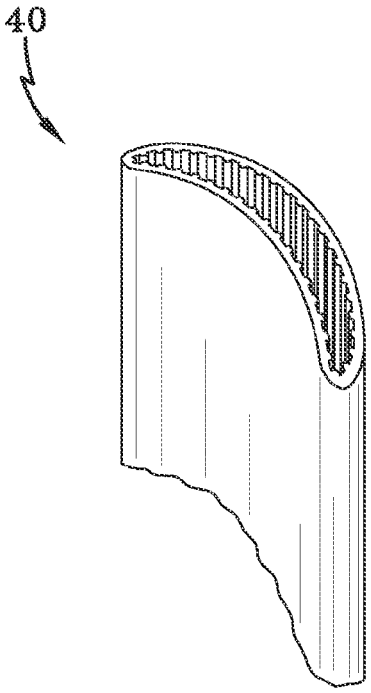
FIG. 5 depicts a braided fiber preform after impregnating the woven fiber with a fugitive polymer binder so that the sock-like shape has the profile of an airfoil.
Figure 6:
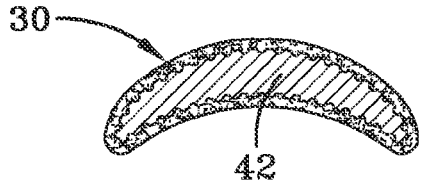
FIG. 6 depicts the placement of a braided fiber preform over a mandrel for dipping into a polymer slurry to form an airfoil profile.

Tows and tows braided into fabric, such as braided fabric 30 can be difficult to handle and may be difficult to precisely locate during manufacture of a blade 10 or airfoil. Handling can be facilitated by fabrication of a preform 40 from braided fabric 30, such as shown in FIG. 5. Referring now to FIG. 6, braided fabric 30 in the form of a sock is fit or stretched over a mandrel 42. Mandrel 42 is formed so that, once braided fabric is fitted or stretched over it, it is in the near net shape of a compressor blade. In this context, near net shape means that the braided fabric 30 positioned over mandrel 42 has a profile that is slightly less than that of a finished blade or airfoil 10, by for example, from about 0.005" to about 0.025" so that braided fabric will not form the outer surface 24 of blade 10 or airfoil. After braided fabric is positioned over mandrel 42, it is dipped in a polymer slurry. After the polymer slurry has been allowed to fill the interstices of braided fabric 30, mandrel 42 is removed from the slurry and the polymer is cured, forming preform 40. The polymer is selected so that it will cure in air or at low temperature. After curing, mandrel 42 can then be removed from the rigidized preform. In this form, the fabric is easier to handle. Preform 40 now may provide the basis to form a blade.

Alternatively, braided fabric 30 may be dipped in a polymer slurry, impregnated with polymer, and removed. In this embodiment, the polymer slurry is allowed to dry but not to cure. Braided fabric remains tacky and pliable so that it can be more readily handled, but it is not rigidized. Braided fabric 30 can now be used to form a compressor blade. The tacky preform advantageously may stick to surfaces during subsequent processing.

Figure 7:
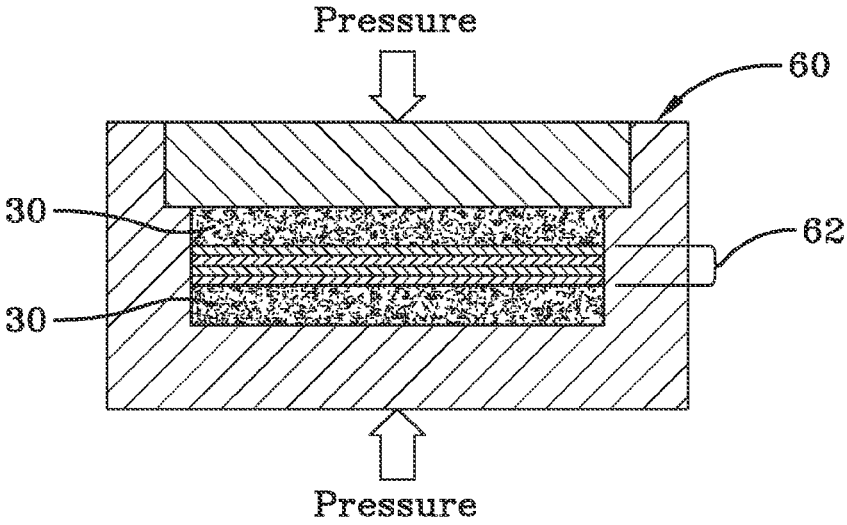
FIG. 7 depicts a method of making a metal matrix composite blade of the present invention utilizing a precision mold under pressure.

In another embodiment, similar to the embodiment described above and in FIG. 6, a mandrel such as mandrel 42 is used in conjunction with a precision tool 60 to form a preform that is rigidized with aluminum-lithium alloy. Braided fabric in the form of a sock is fit or stretched over the mandrel. However, now thin foils of metal foil, aluminum-lithium alloy foil in the preferred embodiment, are placed between the mandrel and the braided fabric. This may be done before or after the braided fabric is fit onto the mandrel. Referring now to FIG. 7, a precision female tool 60 is provided. Metal foil, preferably aluminum-lithium alloy foil in the preferred embodiment, is placed in precision female tool 60 and mandrel 62 that includes braided fabric 30 and foil is placed into tool 60. On insertion into female tool 60, braided fabric is sandwiched between metal foil, preferably aluminum-lithium alloy foil in the preferred embodiment. The tool can now be closed and placed in a non-oxidizing atmosphere. The non-oxidizing atmosphere may be a vacuum or an inert gas, such as argon, helium or neon, or nitrogen atmosphere. Since the tool must be heated, this conveniently can be done in a furnace, although any other arrangement can be used since the tool can be heated using electrical resistance heaters, induction coils, quartz lighting or any other convenient method of heating. While maintaining the non-oxidizing atmosphere, the tool is heated to an elevated temperature while pressure is applied to the tool. The temperature is sufficiently elevated to cause the foil to flow and to consolidate the foil-fabric-foil sandwich to allow the metal, preferably aluminum-lithium alloy in the preferred embodiment, to infiltrate into the interstices in the braided fabric and its tows. For the preferred aluminum lithium alloy, this temperature is in the range of about 1200-1300° F. (649-705°). Preferably the temperature of the furnace is raised to about 45-90° F. (25-50° C.) above the melting point of the metal alloy to assure complete melting and flow of the molten alloy into interstices. Tool 60 is allowed to cool, forming a metal/fabric preform. The preform can then be removed from mandrel 62.

Figure 8:
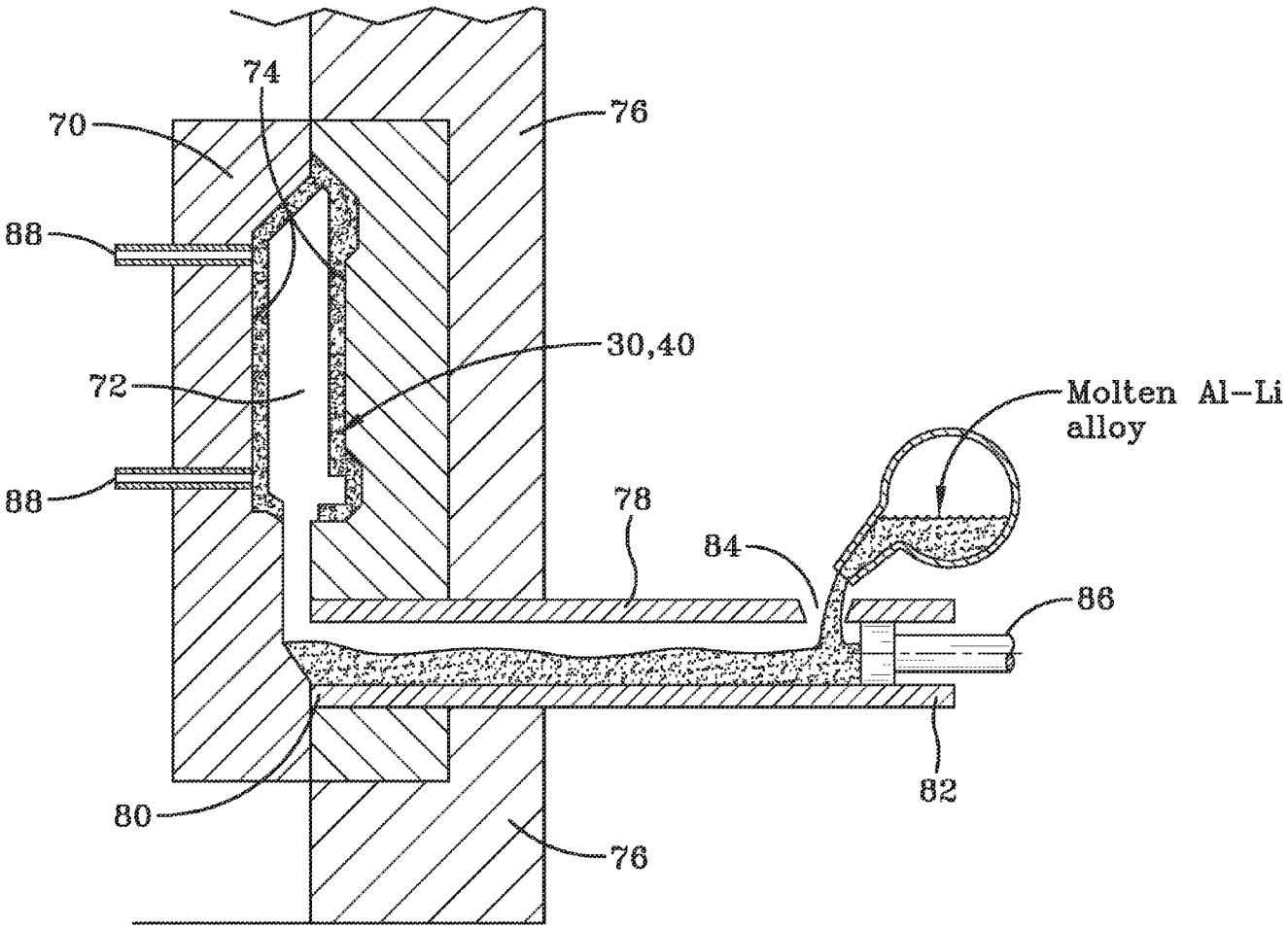
FIG. 8 depicts apparatus for making a metal matrix composite blade of the present invention by pressure augmented casting.

The light weight MMC compressor blade is then fabricated by pressure-augmented casting. This process is depicted in FIG. 8. In this process, a precision die 70 is provided. Precision die 70 has a cavity 72 whose walls 74 form the net shape of a blade 10 or airfoil. Braided fabric 30 is placed in precision die 70 against walls 74 of die 70. Braided fabric 30 may or may not include stuffer tows 34 or softening strips, depending upon the blade design as previously discussed. It is preferred that braided fabric 30 be impregnated with a fugitive polymer binder to facilitate handling and to adhere the fabric to walls 74 of die 70, although it is possible to utilize unimpregnated fabric 30. Most preferably, a rigidized preform 40 discussed above and rigidized using either fugitive polymer or metal alloy, aluminum-lithium alloy in the preferred embodiment, is inserted into the precision die, as rigidized preform 40 advantageously provides superior resistance to movement during subsequent casting operations.

Precision die 70 is then closed and secured in a bolster 76, which secures the halves of precision die 70 together and prevents any movement of precision die 70 during subsequent operation. A runner 78 having a first end 80 in communication with die cavity 72 and a second end 82 outside bolster 76 extends from precision die 70 and through bolster 76. Proximate to second end 82 of runner 78 is a piston 86 which slidably moves within runner 78 between second end 82 and first end 80. An access for pouring 84, such as a pouring cup, is located on runner between first end 80 and second end 82.

Precision die 70 is placed in a non-oxidizing atmosphere. As previously discussed, the non-oxidizing atmosphere may be a vacuum, an inert gas atmosphere or a nitrogen atmosphere. The precision die is then preheated to a preselected first temperature, in the range of about 800-1150° F. (427-621° C.) while maintaining the non-oxidizing atmosphere. This may be accomplished by maintaining the non-oxidizing atmosphere within a furnace and raising the temperature of the furnace, or the precision die can be heated with electrical heaters such as induction coils or resistance coils. Any other convenient method may be used.

While piston 86 is positioned at second end 82 of runner 78, molten metal alloy, such as the preferred aluminum lithium alloy, is cast into runner until cavity 72 and runner 78 is substantially filled to piston 86. For the preferred aluminum lithium alloy, the melting temperature of the alloy is in the range of about 1200-1300° F.). (649-705° and the pouring temperature is about 45-90° F. (25-50° C.) above the melting point of the metal alloy to provide a superheat to assure complete melting and flow of the molten alloy through runner 78, into die cavity 72 and into interstices of braided fabric 30. As molten metal alloy is introduced into die cavity 72, if a fugitive polymer was used to facilitate handling of braided fabric 30, such as to form a preform 40 it melts. The molten metal alloy penetrates the interstices of braided fabric 30, displacing the polymer. Liquid polymer and any gases that may be present in die cavity 72 are displaced into vents 88. The casting process is accomplished quickly, typically in a time of about 10-100 milliseconds. Piston 86 then slidably moves toward first end 80 of runner 78, applying a first pressure molten metal in die cavity. The first pressure is regulated by piston ram speed as the piston moves toward the first end 80 of runner 78. The piston ram speed preferably is in the range of about 10-100 meters per second. This piston forces molten metal alloy into all regions of die cavity 72 and into any unfilled void areas, such as the interstices of braided fabric 30. Some small amount of molten metal alloy may also be forced into vents 88, where the molten metal alloy will quickly solidify, since such vents 88 are small and walls of die 70 are much cooler than the temperature of the metal alloy.

Next, piston 86 is used to apply additional pressure to molten metal alloy in die cavity 72. The pressure is increased to about 10-150 bars. Additional pressure is applied so that molten metal can be forced into any portions of the cavity which are not already filled. The additional pressure also forces molten metal through the interstices and between cavity walls 74 and woven fabric 30, so that braided fabric 30 is displaced to braided fabric 22 position which is slightly below the surface of blade 10 or airfoil so that metal alloy forms outer surface 24 of blade 10 or airfoil. Preferably, the thickness of the metal alloy on outer surface 24 is in the range of about from about 0.002" to about 0.025", preferably 0.005" to about 0.025". The pressure and non-oxidizing atmosphere is maintained while blade 10 or airfoil solidifies and cools. The pressurized metal will eliminate any voids or shrinkage due to solidification as molten metal alloy is forced into these areas of shrinkage. In a properly designed die or mold, the feed area, which in FIG. 8 is runner 78, should be the last region where molten metal alloy solidifies. It should be noted that the die may also include a sprue (not shown) to feed molten metal alloy, as is well known in the industry, if it is necessitated by blade 10 or airfoil design.

After solidification, die 70 can be cooled while maintaining the non-oxidizing atmosphere. After cooling to a temperature at which oxidation is no longer a concern, die may be removed from the furnace and opened. The airfoil or blade 10 may then be removed from die 70 and any clean-up operations to remove runner 78 and flash can be accomplished to provide a finished blade 10 or airfoil.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A composite lightweight compressor airfoil for a turbomachine, comprising:

a near surface braided fabric, wherein the braided fabric further comprises a fabric formed from a plurality of twisted fiber tows braided and oriented in a direction so that each of the plurality of tows extend substantially parallel to one another and substantially parallel to an axis of the airfoil to a principal direction of the airfoil, wherein the principal direction extends from a first end toward a second end of the airfoil;

a core of an aluminum lithium alloy;

an outer surface of the aluminum lithium alloy;

wherein the aluminum-lithium alloy penetrates interstices of the fabric and the plurality of twisted fiber tows so that the aluminum-lithium alloy is substantially continuous; and wherein the tows are stuffer tows further comprising fiber having a high strength and a low elastic modulus, forming up to about 15% of the volume of the fabric.

2. The composite airfoil of claim 1 wherein the tows are included in a tri-axial braid pattern.

3. The composite airfoil of claim 1 wherein the tows are softening strips further comprising fiber having a high elastic modulus, forming up to about 15% of the volume of the fabric.

4. The composite airfoil of claim 3 wherein the softening strips further comprise fiber selected from the group consisting of carbon fiber, fiberglass fiber, nylon fiber, aramid fiber and combinations thereof.

5. The composite airfoil of claim 1 wherein the aluminum lithium alloy further comprises, in weight percent, about 2.5-3.5% Li, about 0.6-2.5% Cu, about 0.3-1.0% Mg, about 0.1-0.5% Zr, up to about 0.08% Fe, up to about 0.01% Si, up to about 0.03% Ti, the balance Al and incidental impurities.

6. The composite airfoil of claim 1 wherein the stuffer tows further comprise fiber selected from the group consisting of carbon fibers, oxide ceramic fibers, non-oxide ceramic fibers, aramid fibers and combinations thereof.

7. A method for manufacturing a composite lightweight compressor airfoil for a turbomachine, comprising the steps of:

forming a plurality of twisted fiber tows;

forming a braided fabric from the plurality of twisted fiber tows, the braided fabric having interstices between the tows;

providing a female tool and a mandrel in a shape of the airfoil, the tool having faces forming a cavity in the shape of the airfoil, and the mandrel having a near net shape of the airfoil;

sandwiching the braided fabric between foils of aluminum-lithium alloy and inserting the sandwich of foil and fabric into the tool;

inserting the mandrel into the tool so that the sandwich of foil and fabric fills the cavity and closing the tool;

while maintaining a non-oxidizing atmosphere, heating the tool to a superheat temperature above the melting point of the alloy and hot pressing the tool while maintaining the superheat temperature and pressure for a time sufficient to consolidate and infiltrate aluminum lithium alloy into the braided fabric tows, creating a fiber-reinforced metal matrix preform;

placing the fiber-reinforced metal matrix preform into a die having a net shape of the airfoil;

while maintaining a non-oxidizing atmosphere, pressure-augmenting casting molten aluminum-lithium alloy into the die and against the metal matrix preform to form a metal matrix composite airfoil having an integral aluminum-lithium alloy core and an aluminum-lithium alloy dovetail attachment; and removing the airfoil from the die after cooling.

8. The method of claim 7 wherein the metal alloy further comprises, in weight percent, about 2.5-3.5% Li, about 0.6-2.5% Cu, about 0.3-1.0% Mg, about 0.1-0.5% Zr, up to about 0.08% Fe, up to about 0.01% Si, up to about 0.03% Ti, the balance Al and incidental impurities.

9. The method of claim 7 wherein the non-oxidizing atmosphere is a vacuum.

10. The method of claim 7 wherein the non-oxidizing atmosphere is an atmosphere selected from the group consisting of an inert gas and nitrogen.

11. The method of claim 7 wherein hot pressing to a superheat temperature includes heating to a temperature about 25-50° C. (45-90° F.) above the melting point of the metal alloy.

12. The method of claim 7 wherein the step of forming the braided fabric additionally includes providing with the braided fabric additional tows selected from the group consisting of stuffer tows and softening strips, the additional tows being substantially parallel to the axis of the airfoil so that the additional tows extend generally in a radial direction with respect to the airfoil, extending from an airfoil tip to an opposite side of the airfoil.

13. A method for manufacturing a composite lightweight compressor airfoil for a turbomachine, comprising the steps of:

forming a plurality of twisted fiber tows;

forming a braided fabric from the plurality of twisted fiber tows into an airfoil shape, the braided fabric having interstices between the plurality of twisted fiber tows;

optionally, impregnating the braided fabric with a fugitive polymer binder to form a preform;

providing a die, the die having die faces forming a cavity in the shape of the airfoil, the die producing a near net shape airfoil;

inserting the braided fabric into the die, the tows forming the fabric being at an angle to an axis of the airfoil, the axis extending in a radial direction from an airfoil tip to an opposite side of the airfoil;

placing the die in a non-oxidizing atmosphere;

preheating the die to a first temperature;

while maintaining the non-oxidizing atmosphere, pressure augmented casting a metal alloy into the die using a piston to apply a first pressure;

then, after the die is filled with molten metal alloy, using the piston to apply a second pressure to infiltrate the interstices of the preform and to penetrate the preform and to volatilize the optional binder, the second metal pressure being greater than the first metal pressure;

while maintaining the non-oxidizing atmosphere, cooling the die to form the airfoil, the airfoil having an outer metal alloy surface and a metal alloy core; and removing the airfoil from the furnace.

14. The method of claim 13 wherein the metal alloy further comprises, in weight percent, about 2.5-3.5% Li, about 0.6-2.5% Cu, about 0.3-1.0% Mg, about 0.1-0.5% Zr, up to about 0.08% Fe, up to about 0.01% Si, up to about 0.03% Ti, the balance Al and incidental impurities.

15. The method of claim 13 further wherein the step of forming the braided fabric into the airfoil shape additionally includes adding stuffer tows to the braided fabric, the stuffer tows being substantially parallel to the axis of the airfoil so that the stuffer tows extend generally in a radial direction with respect to the airfoil tip, from the airfoil tip to the opposite side of the airfoil.

* * * * *